US005912221A

United States Patent [19]

Van Leeuwen et al.

[11] Patent Number: 5,912,221

[45] Date of Patent: Jun. 15, 1999

[54] LAUNDRY DETERGENT COMPOSITION COMPRISING SUBSTANTIALLY WATER-INSOLUBLE POLYMERIC DYE TRANSFER INHIBITING AGENT

[75] Inventors: Petrus Johannes Van Leeuwen, Lancashire, Netherlands; Andre Christian Convents, Diegem, Belgium; Alfred Busch, Londerzeel, Belgium; Thierry Laurent Cachet, Herent, Belgium; Conny Erna Alice Joos, Buggenhout, Belgium

[73] Assignee: Procter & Gamble Company, Cincinnati, Ohio

[21] Appl. No.: 08/849,936

[22] PCT Filed: Dec. 8, 1995

[86] PCT No.: PCT/US95/16250

§ 371 Date: Jun. 20, 1997

§ 102(e) Date: Jun. 20, 1997

[87] PCT Pub. No.: WO96/20996

PCT Pub. Date: Jul. 11, 1996

[30] Foreign Application Priority Data

Dec. 29, 1994 [EP] European Pat. Off. ..... 94870212

[51] Int. Cl.[6] ..... C11D 3/37; C11D 3/39; C11D 3/395; C11D 3/60

[52] U.S. Cl. ..... 510/360; 510/309; 510/312; 510/313; 510/320; 510/352; 510/475; 510/499; 510/501; 510/503

[58] Field of Search ..... 510/475, 499, 510/501, 503, 360, 299, 300, 309, 312, 313, 320, 352

[56] References Cited

U.S. PATENT DOCUMENTS

| | | | |
|---|---|---|---|
| 4,756,849 | 7/1988 | Weber et al. | 252/542 |
| 5,077,047 | 12/1991 | Biss et al. | 525/387 |
| 5,259,994 | 11/1993 | Welch et al. | 252/542 |
| 5,360,567 | 11/1994 | Fry et al. | 252/90 |
| 5,460,752 | 10/1995 | Fredj et al. | 252/542 |
| 5,466,802 | 11/1995 | Panandiker et al. | 544/193.2 |

FOREIGN PATENT DOCUMENTS

| | | |
|---|---|---|
| 0 581 752 | 2/1994 | European Pat. Off. . |
| 28 14 287 | 10/1979 | Germany . |

*Primary Examiner*—Ardith Hertzog
*Attorney, Agent, or Firm*—Richard S. Echler, Sr.; Brian M. Bolam; Kim William Zerby

[57] ABSTRACT

The present invention relates to laundry detergent compositions which are suitable for use in inhibiting the re-deposition of fugitive dyes onto fabric during the course of the laundry process, said compositions comprising:

a) 0.01% to 3% by weight, of a substantially water-insoluble polymeric dye transfer inhibiting agent, said agent consisting of a substantially water-insoluble cross linked polymer selected from the group consisting of polyamine N-oxide polymers; copolymers of N-vinylpyrrolidone and N-vinylimidazole; polyvinylpyrrolidones; polyvinyloxazolidones; polyvinylimidazoles; and mixtures thereof; wherein said agents have a particle size less than 50 microns;

b) from 0.2% to 25% by weight of a surfactant system, said surfactant system comprising one or more detersive surfactants selected from the group consisting of anionic, nonionic, cationic, zwitterionic, ampholytic surfactants, and mixtures thereof; and c) the balance carriers and adjunct ingredients.

The compositions of the present invention are also compatible with peroxygen, as well as, hypochlorite bleaching systems.

10 Claims, No Drawings

LAUNDRY DETERGENT COMPOSITION COMPRISING SUBSTANTIALLY WATER-INSOLUBLE POLYMERIC DYE TRANSFER INHIBITING AGENT

FIELD OF THE INVENTION

The present invention relates to laundry detergent compositions capable of providing color care benefits.

BACKGROUND OF THE INVENTION

The laundering of colored garments is well recognized by the consumer, as well as the detergent manufacturer, as being a delicate operation, in that it may involve issues such as dye bleeding from fabrics, and dye transfer between fabrics, during the laundry process; these phenomenon may lead to the undesirable result of color alteration of the laundered garments.

One aspect of this concern can be addressed by using dye transfer inhibiting polymers in laundry detergent compositions. These polymers have the ability to complex or absorb the fugitive dyes washed out of dyed fabrics before the dyes have the opportunity to become attached to other articles in the wash.

Such polymers which have been disclosed for use within detergent compositions to inhibit dye transfer are water-soluble species, and include vinylpyrrolidone polymers, polyamine N-oxide polymers and copolymers of vinylpyrrolidone and N-vinylimidazole.

It has now been surprisingly found that if a water-insoluble system containing said polymer is used, excellent color fidelity benefits, i.e. not only excellent dye transfer inhibition, but also anti-fading benefits are provided.

It has further been found that a synergistic dye transfer inhibition action is obtainable if said water-insoluble systems are used in combination with the known water-soluble species above.

SUMMARY OF THE INVENTION

The present invention relates to laundry detergent compositions comprising a polymeric dye transfer inhibiting agent, characterized in that the polymeric dye transfer inhibiting agent is substantially water-insoluble.

DETAILED DESCRIPTION OF THE INVENTION

The compositions of the present invention comprise as an essential element a substantially water-insoluble dye transfer inhibiting agent.

The substantially water insoluble dye transfer inhibition agent

The substantially water insoluble polymeric dye transfer inhibition agent may consist of a water-soluble dye transfer inhibition polymer, bound to a water-insoluble carrier, or it may consist of a dye tranfer inhibition polymer which in itself is water-insoluble. By substantially water insoluble, it is meant that the polymeric dye transfer inhibition agents should have a solubility in deionized water at 20° C. of less than 1 g/liter.

Water-insoluble carriers for water-soluble polymers include inorganic materials such as zeolites as described hereinafter as detergent ingredients and clays, such as kaolinites, smectites, hectorite types, as well as silicas such as Gasil 200 and Sorbsil ex Crossfield Chemicals.

Additionally, organic water-insoluble materials such as fatty alcohols having an alkyl chain length of at least 14 carbon atoms, esters of fatty acids of an alkyl chain length of at least C18 with lower monohydric alcohols can be used as carriers herein; organic polymeric materials are also suitable, such as those described in EPA 397 245, defined by their molecular weight, melting point and hardness value.

Also suitable are AVICEL®, microcristalline cellulose, or other glucose derivatives, such as chitin, or chitosan, as well as starch derivatives.

For the polymers themselves, water insolubility can be achieved by cross-linking, either starting from the known water soluble dye transfer inhibiting polymers, such as polyamine N-oxide polymers, copolymers of N-vinylpyrrolidone and N-vinylimidazole, polyvinylpyrrolidone polymers, polyvinyloxazolidones and polyvinylimidazoles or mixtures thereof, or starting from monomers of the above polymers.

Water insolubility can, in the case of non-cross-linked polymers, also be achieved by selecting very high molecular weight range, or by copolymerizing, or by varying the degree of oxidation if appropriate, depending on the polymer. Preferred for use herein are cross-linked polymers:

Cross-linked polymers

Cross-linked polymers are polymers whose backbone are interconnected to a certain degree; these links can be of chemical or physical nature, possibly with active groups on the backbone or on branches; the supramolecular structure of these 'network' or 'popcorn' polymers forms, at least partially, an inter-connected network; Cross-linked polymers have been described in the Journal Polymer Science, volume 22, pages 4035–4039 (1984). Such polymers have found application as thickening agents in detergent or cosmetic compositions. Cross-linked polymers can exist as semi- or completely inter-penetrating networks; (M. Alger "Polymer science dictionary" Elsevier Science publ. ltd, 1989).

Cross-links can be formed (a) Between already existing linear or branched polymers (vulcanization, peroxide cross-linking).

(b) During the polymerization of multi-functional monomers.

(c) During the polymerization of dimeric monomers with traces of multi-functional monomers.

The cross-linked polymers for use herein typically have an average particle size below 50 microns, preferably of from 1 to 30 microns.

In one embodiment herein, the cross-linked polymers are made in such a way that they form a three-dimensional rigid structure, which can entrap dyes in the pores formed by the three-dimensional structure. In another embodiment, the cross-linked polymers entrap the dyes by swelling; for those polymers, the swelling volume should be superior to 1.5 without gel formation, as described in e.g. Caramella et al, Acta Pharm. Tech.30 (1984) or "Gissenger and Stanm, Pham.Ind 42 (1980).

The polymers from which cross-linking can be achieved for the purpose of the present invention are those described hereinafter under the "water-soluble" heading.

High molecular weight polymers

Polymers of the type described hereinafter as water soluble, may be made insoluble if their molecular weight is increased above 400,000.

In the embodiment of the present invention where a water-insoluble carrier is used, the dye transfer inhibition polymer will be selected from the list of water-soluble species as well.

The level of water-insoluble dye transfer polymer in the compositions herein is in the range of from 0.01 to 3%, preferably from 0.05 to 1.2% by weight.

Optional Ingredients

In addition to the essential ingredients described above, the compositions herein can comprise:

Water Soluble Dye Transfer Inhibition Polymers

According to an optional, but preferred embodiment of the present invention, the substantially water insoluble dye transfer inhibition agents described hereinabove, are combined with water soluble polymers, in a weight ratio of respectively 10:0.1 to 1:5 preferably 10:1 to 1:1.

The water-soluble polymers are selected from the following species:

a) Polyamine N-oxide polymers

Said polyamine N-oxide polymers contain units having the following structure formula:

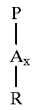

(I)

wherein

P is a polymerisable unit, whereto the R—N—O group can be attached to or wherein the R—N—O group forms part of the polymerisable unit or a combination of both.

A

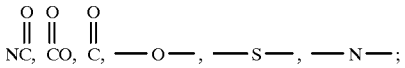

x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

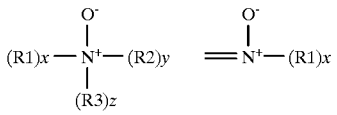

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both. Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof. Another class of said polyamine N-oxides comprises the group of polyamine N-oxides wherein the nitrogen of the N-O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyrridine, pyrrole, imidazole and derivatives thereof. Another preferred class of polyamine N-oxides are the polyamine oxides having the general formula (I) wherein R are aromatic, heterocyclic or alicyclic groups wherein the nitrogen of the N-0 functional group is attached to said R groups. Examples of these classes are polyamine oxides wherein R groups can be aromatic such as phenyl.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6. The polyamine oxides can be obtained in almost any degree of polymerisation. The degree of polymerisation is not critical provided the material has the desired water-solubility and dye-suspending power. Typically, the average molecular weight of water soluble species is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

The N-vinylimidazole N-vinylpyrrolidone polymers typically have an average molecular weight range from 5,000–1,000,000, preferably from 20,000–200,000. Highly preferred polymers for use herein comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000. The average molecular weight range was determined by light scattering as described in Barth H. G. and Mays J. W. Chemical Analysis Vol 113, "Modern Methods of Polymer Characterization". Highly preferred N-vinylimidazole N-vinylpyrrolidone copolymers have an average molecular weight range from 5,000 to 50,000; more preferably from 8,000 to 30,000; most preferably from 10,000 to 20,000. The N-vinylimidazole N-vinylpyrrolidone copolymers useful herein have a molar ratio of N-vinylimidazole to N-vinylpyrrolidone from 1 to 0.2, more preferably from 0.8 to 0.3, most preferably from 0.6 to 0.4 c) Polyvinylpyrrolidone

Water soluble polyvinylpyrrolidones ("PVP") have an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially vailable from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000).

Other suitable polyvinylpyrrolidones which are commercially available from BASF Cooperation include Sokalan HP 165 and Sokalan HP 12. Polyvinylpyrrolidones known to persons skilled in the detergent field; see for example EP-A-262,897 and EP-A-256,696.

d) Polyvinyloxazolidone

Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

e) Polyvinylimidazoles

Said polyvinylimidazoles have an average about 2,500 to about 400,000, preferably from about 5,000 to about 200,000, more preferably from about 5,000 to about 50,000, and most preferably from about 5,000 to about 15,000.

f) Cationic polymers

Such polymers are those having a cationic group into their polymeric backbone, as shown by the formula:

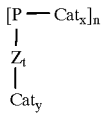

wherein P represents polymerisable units, Z represents alkyl or aryl groups, oxygen or ester, ether, amide, amine group, Cat represents cationic groups, preferably including quaternized N groups, such as defined in formulae (1) and (2) hereinafter or other cationic units, x=0 or 1, y=0 or 1, t=0 or 1.

Examples of cationic polymers include polyethyleneimine (Polymin, ex BASF), polydiallyldimethylammoniumchloride (Polydadmac, ex Hoechst) and (Copolymers with quaternized groups like dimethylaminoethylacrylate (Copolymer 845, & Gafquat, ex ISP).

Detergent Adjuncts

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 8.5 to 13.5, more preferably from 8.5 to 11.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

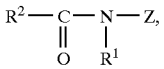

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Other suitable nonionic surfactants include long chain amine oxides, long chain phosphonic oxides, and dialkyl sulfoxides. Cationic detersive surfactants suitable for use in the laundry detergent compositions of the present invention are those having one long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]_2R^5N^+X^- \quad (1)$$

wherein $R^2$ is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Highly preferred cationic surfactants are the water-soluble quaternary ammonium compounds useful in the present composition having the formula:

$$R_1R_2R_3R_4N^+X^- \quad (2)$$

wherein R1 is $C_8$–$C_{16}$ alkyl, each of $R_2$, $R_3$ and $R_4$ is independently $C_1$–C4 alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis.

Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12-15}$ dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide;

lauryl dimethyl (ethenoxy)4 ammonium chloride or bromide;

choline esters (compounds of formula (i) wherein $R_1$ is $CH_2$—$CH_2$—O—C(O)—$C_{12-14}$ alkyl and $R_2R_3R_4$ are methyl).

di-alkyl imidazolines [compounds of formula (i)].

Other cationic surfactants useful herein are also described in U.S. Pat. No. 4,228,044, Cambre, issued Oct. 14, 1980 and in European Patent Application EP 000 224.

When included therein, the composite detergent compositions of the present invention typically comprise from 0.2% to about 25%, preferably from about 1% to about 8% by weight of such cationic surfactants.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 2,985,669, Krummel, et al, issued Oct. 12, 1976. Preferred synthetic crystalline aluminosilicate ion exchange materials herein are available under the designations Zeolite A, Zeolite P(B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and and carboxymethyl derivatives of polyhydric alcohols such as sorbitol, mannitol and xylitol. Aromatic polycarboxylates include mellitic acid, pyromellitic acid and the phtalic acid derivatives disclosed in British Patent No. 1,425,343.

Of the above, the preferred polycarboxylates are hydroxycarboxylates containing up to three carboxy groups per molecule, more particularly citrates. Preferred builder systems for use in the present compositions include a mixture of a water-insoluble aluminosilicate builder such as zeolite A or of a layered silicate (SKS6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Especially for the liquid execution herein, suitable fatty acid builders for use herein are saturated or unsaturated C10–18 fatty acids, as well as well as the corresponding soaps. Preferred saturated species have from 12 to 16 carbon atoms in the alkyl chain. The preferred unsaturated fatty acid is oleic acid. Preferred builder systems for use in granular compositions include a mixture of a water-insoluble aluminosilicate builder such as zeolite A, and a water-soluble carboxylate chelating agent such as citric acid. Other builder materials that can form part of the builder system for use in granular compositions the purposes of the invention include inorganic materials such as alkali metal carbonates, bicarbonates, silicates, and organic materials such as the organic phosphonates, amino polyalkylene phosphonates and amino polycarboxylates. Other suitable water-soluble organic salts are the homo- or co-polymeric acids or their salts, in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Detergent ingredients that can be included in the detergent compositions of the present invention include bleaching agents. These bleaching agent components can include one or more oxygen bleaching agents and, depending upon the bleaching agent chosen, one or more bleach activators. When present bleaching compounds will typically be present at levels of from about 0.5% to about 10%, of the detergent composition. In general, bleaching compounds are optional components in non-liquid formulations, e.g. granular detergents. If present, the amount of bleach activators will typically be from about 0.1% to about 60%, more typically from about 0.5% to about 40% of the bleaching composition.

The bleaching agent component for use herein can be any of the bleaching agents useful for detergent compositions including oxygen bleaches as well as others known in the art.

In a method aspect, this invention further provides a method for cleaning fabrics, fibers, textiles, at temperatures below about 50C, especially below about 40° C., with a detergent composition containing polyamine N-oxide containing polymers, optional auxiliary detersive surfactants, optional detersive adjunct ingredients, and a bleaching agent. The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino-6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

Preferably, the bleaches suitable for the present invention include peroxygen bleaches. Examples of suitable water-soluble solid peroxygen bleaches include hydrogen peroxide releasing agents such as hydrogen peroxide, perborates, e.g. perborate monohydrate, perborate tetrahydrate, persulfates, percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzenesulfonate (NOBS, described in U.S. Pat. No. 4,412,934), 3,5,-trimethylhexanoloxybenzenesulfonate (ISONOBS, described in EP 120,591) or pentaacetylglucose (PAG), which are perhydrolyzed to form a peracid as the active bleaching species, leading to improved bleaching effect. Also suitable activators are acylated citrate esters (ATC) such as disclosed in Copending European Patent Application No. 91870207.7.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0.025% to about 1.25%, by weight, of sulfonated zinc phthalocyanine.

Bleach catalysts

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594, U.S. Pat. No. 5,194,416, U.S. Pat. No. 5,114,606, and European Patent App. Pub. Nos. 549 271 A1, 549 272 A1, 544 440 A2, and 544 490 A1; Preferred examples of these catalysts include $Mn^{IV}{}_2$(u-O)$_3$(1,4,7-trimethyl-1,4,7-triazacyclononane)$_2$ $(PF_6)_2$, $Mn^{III}{}_2$(u-O)$_1$(u-

OAc)$_2$(1,4,7-trimethyl-1,4,7-triaza-cyclono-nane)$_2$-(C1O$_4$)$_2$, Mn$^{IV}$$_4$(u-O)$_6$(1,4,7-triazacyclono-nane)$_4$-(C1O$_4$)$_4$, Mn$^{III}$Mn$^{IV}$$_4$(u-O)$_1$(u-OAc)$_2$-(1,4,7-trimethyl-1,4,7-triazacyclononane)$_2$(C1O$_4$)$_3$, Mn$^{IV}$(1,4,7-trimethyl-1,4,7-triazacyclononane)-(OCH$_3$)$_3$(PF$_6$), and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; 5,227,084.

Other detergent ingredients that can be included are detersive enzymes which can be included in the detergent formulations for a wide variety of purposes including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin.

Enzymes are normally incorporated at levels sufficient to provide up to about 5 mg by weight, more typically about 0.05 mg to about 3 mg, of active enzyme per gram of the composition.

Suitable examples of proteases are the subtilisins which are obtained from particular strains of *B.subtilis* and *B.licheniforms*. Proteolytic enzymes suitable for removing protein-based stains that are commercially available include those sold under the tradenames Alcalase , Savinase and Esperase by Novo Industries A/S (Denmark) and Maxatase by International Bio-Synthetics, Inc. (The Netherlands) and FN-base by Genencor, Optimase and opticlean by MKC.

Of interest in the category of proteolytic enzymes, especially for liquid detergent compositions, are enzymes referred to herein as Protease A and Protease B. Protease A is described in European Patent Application 130,756. Protease B is described in European Patent Application Serial No. 87303761.8. Amylases include, for example, -amylases obtained from a special strain of *B.licheniforms,* described in more detail in British Patent Specification No. 1,296,839 (Novo). Amylolytic proteins include, for example, Rapidase, Maxamyl (International Bio-Synthetics, Inc.) and Termamyl, (Novo Industries).

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2.075.028 ; GB-A-2.095.275 and DE-OS-2.247.832.

Examples of such cellulases are cellulases produced by a strain of Humicola insolens (Humicola grisea var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander). Other suitable cellulases are cellulases originated from Humicola Insulens having a molecular weight of about 50 KDa, an isoelectric point of 5.5 and containing 415 amino acids. Such cellulase are described in Copending European patent application No. 93200811.3, filed Mar. 19, 1993. Especially suitable cellulase are the cellulase having color care benefits. Examples of such cellulases are cellulase described in European patent application No. 91202879.2, filed Nov. 6, 1991 Carezyme (Novo).

Suitable lipase enzymes for detergent usage include those produced by microorganisms of the Pseudomonas group, such as Pseudomonas stutzeri ATCC 19.154, as disclosed in British Patent 1,372,034. Suitable lipases include those which show a positive immunoligical cross-reaction with the antibody of the lipase, produced by the microorganism Pseudomonas fluorescent IAM 1057. This lipase is available from Amano Pharmaceutical Co. Ltd., Nagoya, Japan, under the trade name Lipase P "Amano," hereinafter referred to as "Amano-P". Especially suitable lipases are lipases such as M1 Lipase (Ibis) Lipolase (Novo), and variants which show a positive immunoligical cross-reaction with these lipases. In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate and calcium propionate. Calcium ions can be used in combination with short chain carboxylic acid salts, preferably formates. See, for example, U.S. Pat. No. 4,318,818. It has also been proposed to use polyols like glycerol and sorbitol. Alkoxyalcohols, dialkylglycoethers, mixtures of polyvalent alcohols with polyfunctional aliphatic amines (e.g., such as diethanolamine, triethanolamine, di-isopropanolamime, etc.), and boric acid or alkali metal borate. Enzyme stabilization techniques are additionally disclosed and exemplified in U.S. Pat. No. 4,261,868, U.S. Pat. No. 3,600,319, and European Patent Application Publication No. 0 199 405, Application No. 86200586.5. Non-boric acid and borate stabilizers are preferred. Enzyme stabilization systems are also described, for example, in U.S. Pat. Nos. 4,261,868, 3,600,319 and 3,519,570. Other suitable detergent ingredients that can be added are enzyme oxidation scavengers which are described in Copending European Patent application N 92870018.6 filed on Jan. 31, 1992. Examples of such enzyme oxidation scavengers are ethoxylated tetraethylene polyamines. Especially preferred detergent ingredients are combinations with technologies which also provide a type of color care benefit. Examples of these technologies are cellulase and/or peroxidases and/or metallo catalysts for color maintenance rejuvenation.

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alcanols are 2-butyl-octanol which are commercially available under the trade name Isofol 12 R. Such suds suppressor system are described in Copending European Patent application N 92870174.7 filed Nov. 10 1992.

Especially preferred silicone suds controlling agents are described in Copending European Patent application N°092201649.8 Said compositions can comprise a silicone/silica mixture in combination with fumed nonporous silica such as Aerosil$^R$.

The suds suppressors described above are normally employed at levels of from 0.001% to 2% by weight of the composition, preferably from 0.01% to 1% by weight.

Other components used in detergent compositions may be employed, such as soil-suspending agents soil-release agents, optical brighteners, abrasives, bactericides, tarnish inhibitors, coloring agents, and non-encapsulated and encapsulated perfumes.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 80%, most preferably from 1% to 6% by weight of the composition.

Preferred optical brighteners are anionic in character, examples of which are disodium 4,4'-bis-(2-diethanolamino-4-anilinnno-s-triazin-6-ylamino)stilbene-2,2'-disulphonate; disodium 4,4'-bis-(2-morphilino-4-anilino-s-triazin-6-ylamino)stilbene-2,2'-disulphonate; disodium 4,4'-bis-(2,4-dianilino-s-triazin-6-ylamino)stilbene-2,2'-disulphonate; monosodium 4,4'-bis-(2,4-dianilino-s-triazin-6-ylamino) stilbene-2-sulphonate; disodium 4,4'-bis-[2-anilino-4-(N-methyl-N-2-hydroxyethylamino)]-s-triazin-6-ylamino) stilhene-2:2'-disulphonate; disodium 4,4'-bis(4-phenyl-2,1,3-triazol-2-yl)stilbene-2,2'-disulfonate; disodium 4,4'-bis-[2-anilino-4-(1-methyl-2-hydroxyethylamino)-s-triazin-6-ylamino]stilbene-2,2'-disulfonate; and sodium 2-[stilbenyl-4"-(naphtho-1'2',4,5)-2,1,3-triazole]-2"-sulphonate.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T\text{-}PO)_{2.8}(T\text{-}PEG)_{0.4}]T(PO\text{-}H)_{0.25}((PEG)_{43}CH_3)_{0.75}$$

where PEG is —$(OC_2H_4)O$—,PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1–2 propane diol, the end groups consisting primarily of sulphobenzoate and secondarily of mono esters of ethylene glycol and/or propane-diol. The target is to obtain a polymer capped at both end by sulphobenzoate groups, "primarily", in the present context most of said copolymers herein will be end-capped by sulphobenzoate groups. However, some copolymers will be less than fully capped, and therefore their end groups may consist of monoester of ethylene glycol and/or propane 1–2 diol, thereof consist "secondarily" of such species.

The selected polyesters herein contain about 46% by weight of dimethyl terephtalic acid, about 16% by weight of propane-1.2 diol, about 10% by weight ethylene glycol about 13% by weight of dimethyl sulfobenzoid acid and about 15% by weight of sulfoisophtalic acid, and have a molecular weight of about 3.000. The polyesters and their method of preparation are described in detail in EPA 311 342.

The detergent compositions according to the invention can be in liquid, paste, gels or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "concentrated form", in such case, the liquid detergent compositions according to the present invention will contain a lower amount of water, compared to conventional liquid detergents. Typically, the water content of the concentrated liquid detergent is less than 30%, more preferably less than 20%, most preferably less than 10% by weight of the detergent compositions.

The present invention also relates to a process for inhibiting dye transfer, and providing anti-fading benefits, in laundering operations involving colored fabrics; the present invention also relates to a process for improving whiteness, and preventing dinginess in laundry operations involving white fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. and higher temperatures. The pH of the treatment solution is preferably from 7 to 11, especially from 7.5 to 10.5.

The process and compositions of the invention can also be used as detergent additive products. Such additive products are intended to supplement or boost the performance of conventional detergent compositions.

EXAMPLES

Abbreviations

LAS: Sodium linear C12 alkyl benzene sulphonate

TAS: Sodium tallow alkyl sulphate

45AS: A $C_{14}$–$C_{15}$ predominantly linear primary alcohol condensed with an average of 45 moles of ethylene oxide 45E7: A $C_{14}$–$C_{15}$ predominantly linear primary alcohol condensed with an average of 7 moles of ethylene oxide 35E3S: $C_{13}$–$C_{15}$ sodium alkyl sulfate condensed with an average of 3 moles of ethylene oxide per mole 68E11: A $C_{16}$–$C_{18}$ predominantly linear primary alcohol condenser with an average of 11 moles of ethylene oxide 25E5: A $C_{12}$–$C_{15}$ predominantly linear primary alcohol condenser with an average of 5 moles of ethylene oxide 25E3: A $C_{12}$–$C_{15}$ predominantly linear primary alcohol condenser with an average of 3 moles of ethylene oxide CFAA: $C_{12}$–$C_{14}$ alkyl N-methyl glucamide
TFAA: $C_{16}$–$C_{18}$ alkyl N-methyl glucamide
APG: Alkyl polyglucoside surfactant of formula $C_{12}$-(glucosyl)$_x$, where x is 1.5
Cationic: Quaternary ammonium compound selected from coco-alkyl dimethyl hydroxyethyl ammonium chloride, or coco-alkyl choline ester, and mixtures thereof
Silicate: Amorphous Sodium Silicate ($SiO_2$:$Na_2O$ ratio=2.0)
Na-SKS-6: Crystalline layered silicate of formula δ-$Na_2Si_2O_5$
Carbonate: Anhydrous sodium carbonate
MA/AA: Copolymer of 1:4 maleic/acrylic acid, average molecular weight about 80,000
Zeolite A: Hydrated Sodium Aluminosilicate of formula $Na_{12}(A1O_2SiO_2)_{12}$. $27H_2O$ having a primary particle size in the range from 1 to 10 micrometers
Citrate: Tri-sodium citrate dihydrate
Phosphate: Sodium tripolyphosphate
PB4: Anhydrous sodium perborate tetrahydrate
Percarbonate: Anhydrous sodium percarbonate bleach of empirical formula $2Na_2CO_3.3H_2O_2$
TAED: Tetraacetyl ethylene diamine
Protease: Proteolytic enzyme sold under the tradename Savinase by Novo Nordisk A/S.
Lipase: Lipolytic enzyme sold under the tradename Lipolase by Novo Nordisk A/S
Cellulase: Cellulosic enzyme sold under the tradename Carezyme or Celluzyme by Novo Nordisk A/S.
Amylase: Bacterial or fungal amylolitic enzyme sold under the tradenames Termamyl and Fungamyl
DETPMP: Diethylene triamine penta (methylene phosphonic acid), marketed by Monsanto under the Trade name Dequest 2060
Sulphate: Anhydrous sodium sulphate.
PVP: Polyvinylpyrrolidone
PVNO: Polyvinyl N-oxide
PVPVI: Poly(4-vinylpyridine)-N-oxide/copolymer of vinylimidazole and vinyl pyrrolidone

EXAMPLE 1

The following granular detergent compositions were prepared:

| Ingredients | Composition A % by weight | Example I |
|---|---|---|
| LAS | 7.0 | 7.0 |
| TAS | 2.5 | 2.5 |
| 35E3S | 0.05 | 0.05 |
| 45E7 | 5.0 | 5.0 |
| 25E5 | 3.0 | 3.0 |
| Zeolite A | 27.0 | 27.0 |
| Citrate | 10.5 | 10.5 |
| Carbonate | 11.0 | 11.0 |
| Silicate | 2.0 | 2.0 |
| Bicarbonate | 5.0 | 5.0 |
| MA/AA | 5.0 | 5.0 |
| PVPVI | 0.25 | |
| Cross-linked PVPVI | | 0.25 |
| Alcalase 3.0 AU | 0.40 | 0.40 |
| Lipolase 165 KLU | 0.15 | 0.15 |
| Cellulase 1 K | 0.1 | 0.1 |
| Termamyl 60T | 0.4 | 0.4 |
| Sulphate | 5.0 | 5.0 |
| DETMP | 0.6 | 0.6 |
| Perfume, silicone suds suppressor, minors | up to 100 | |

I. Improved dye transfer inhibition performance
The following test was conducted Linitest wash, 30 min at 40° C., 1 cycle, 200 ml, 0.7% product usage. Test fabrics per cycle: 1 white cotton test fabric 10A from Test Fabrics Inc. (UK) and 1 colored cotton bleeding item, size 10×4 cm. Dye transfer on white cotton was measured by Hunter Lab and expressed in ΔE units. Lower ΔE means better dye transfer inhibition performance, a difference in ΔE units of 1 indicated a statistically significant difference in dye transfer.

Results

| Colored bleeding item | Composition A | Example I |
|---|---|---|
| Green item, ΔE | 5.5 | 4.4 |
| Brown item, ΔE | 19.5 | 11.0 |
| Orange item, ΔE | 20.7 | 11.6 |

The above results show the superiority of a composition according to the present invention (Ex. 1) versus reference composition A.

II. Improved color fidelity: The following test was conducted

Miele wash machines, full 8 cycle at 40° C., 126 gr product usage, 3.5 kg clean white cotton and polyester load plus colored item (1 colored item per test). Visual grading was conducted on colored item, by 5 judges, and results reported in Panel Score Units, using the five point Scheffe scale.

+ indicates a better color fidelity appearance of the colored item after washing versus the reference. S indicates a statistically significant result at 95% confidence.

Results (Example 1 versus Composition A

| Colored fabrics | PSU |
|---|---|
| Green item | +1.4S |
| Brown item | +2.1S |
| Yellow item | +1.5S |
| Orange shirt | +1.5S |
| Red item | +1.2S |
| Rose item | +1.2S |
| Jeans | +1.9S |
| Blue item | +1.8S |

The above results show the superiority of a composition according to the present invention (Ex. 1) versus reference composition A.

Other granular fabric cleaning compositions in accord with the invention were also prepared according to the following formulae

| Ingredient | Ex. 2 | Ex. 3 | Ex.4 | Ex. 5 | Ex. 6 | Ex. 7 | Ex. 8 | Ex. 9 |
|---|---|---|---|---|---|---|---|---|
| LAS | 11.0 | 7.0 | — | — | — | — | — | — |
| TAS | 2.0 | — | — | — | — | — | — | — |
| 45AS | — | 2.0 | 4.0 | — | 10.0 | 10.0 | 10.0 | 10.0 |
| 45E7 | 4.0 | 4.0 | — | — | — | — | 2.0 | 2.0 |
| 25E3S | — | — | 3.0 | 3.0 | 3.0 | — | 3.0 | 3.0 |
| 68E11 | 2.0 | — | — | — | 2.0 | — | — | — |
| 25E5 | — | — | 8.0 | 8.0 | 3.0 | — | — | — |
| 25E3 | — | — | — | — | — | 5.0 | 2.0 | 2.0 |
| TFAA | — | — | — | — | 4.0 | — | — | — |
| APG | — | — | — | — | — | — | 2.0 | 2.0 |
| Cationic | — | — | — | — | — | 1.0 | — | — |
| Citrate | 14.0 | 5.0 | 7.0 | 7.0 | 14.0 | 3.0 | 14.0 | 14.0 |
| Carbonate | — | 10.0 | 10 | 10 | — | 10.0 | — | — |
| Citric acid | 3.0 | 5.0 | 3.0 | 3.0 | 3.0 | 3.0 | 3.0 | 3.0 |
| Zeolite A | 32.0 | 15.0 | 25.0 | 25.0 | 32 | 15.0 | 32 | 32 |
| Na-SKS-6 | — | — | 9.0 | 9.0 | — | 11.0 | — | — |
| MA/AA | 5.0 | 4.0 | 5.0 | 5.0 | 5 | 4.0 | 5 | 5 |
| DETPMP | 1.0 | 0.4 | 0.8 | 0.8 | 1.0 | 0.4 | 1.0 | 1.0 |
| PB4 | — | 15.0 | — | — | — | — | — | — |
| Percarbonate | — | — | — | — | — | 15.0 | 15.0 | 15.0 |
| TAED | — | 5.0 | — | — | — | 5.0 | 5.0 | 5.0 |
| Protease | 0.02 | 0.01 | 0.01 | 0.01 | 0.02 | 0.01 | 0.02 | 0.02 |
| Lipase | 0.002 | 0.005 | 0.005 | 0.005 | 0.01 | 0.01 | 0.002 | 0.002 |
| Amylase* | 0.03 | 0.005 | 0.005 | 0.005 | — | 0.005 | 0.03 | 0.03 |
| Cellulase* | 0.005 | 0.001 | 0.001 | 0.001 | — | 0.001 | 0.005 | 0.005 |
| Silicate* | 2.0 | 3.0 | — | — | 2.0 | 05.0 | 2.0 | 2.0 |
| Sulphate* | 3.5 | 3.0 | 3.0 | 3.0 | 3.5 | 3.0 | 3.5 | 3.5 |
| Cross-linked PVNO | 0.3 | — | 0.3 | — | 0.2 | — | 0.2 | — |
| Cross-linked PVPVI | — | 0.2 | — | 0.2 | — | 0.2 | — | — |
| Cross-linked PVP | | | | | | | 0.5 | 0.5 |
| PVNO | — | — | 0.1 | — | 0.1 | — | 0.1 | — |
| PVPVI | — | 0.1 | — | 0.15 | — | | — | — |
| Water/minors | | | | up to 100% | | | | |

* indicated are pure enzyme levels

The following granular detergent composition in accordance with the invention were also prepared

| Ingredient | Ex. 10 | Ex. 11 | Ex. 12 | Ex. 13 |
|---|---|---|---|---|
| LAS | 22.0 | 22.0 | 22.0 | 22.0 |
| Phosphate | 23.0 | 23.0 | 23.0 | 23.0 |
| Carbonate | 23.0 | 23.0 | 23.0 | 23.0 |
| Silicate | 14.0 | 14.0 | 14.0 | 14.0 |
| Zeolite A | 8.2 | 8.2 | 8.2 | 8.2 |
| DETPMP | 0.4 | 0.4 | 0.4 | 0.4 |
| Sodium sulfate | 5.5 | 5.5 | 5.5 | 5.5 |
| Protease | 0.01 | 0.02 | 0.01 | 0.005 |
| Lipase | 0.005 | 0.001 | 0.002 | 0.005 |
| Cellulase | 0.001 | — | — | 0.001 |
| Amylase | 0.01 | — | 0.01 | — |
| Cross-linked PVP | 0.2 | 0.2 | — | — |
| Cross-linked PVNO | — | — | 0.3 | — |
| Cross-linked PVPVI | — | — | — | 0.2 |
| PVP | — | 0.1 | — | — |
| Water/minors | | Up to 100 | | |

What is claimed is:

1. A laundry detergent composition comprising:

a) 0.01% to 3% by weight, of a substantially water-insoluble polymeric dye transfer inhibiting agent, said agent consisting of a substantially water-insoluble cross linked polymer selected from the group consisting of polyamine N-oxide polymers; copolymers of N-vinylpyrrolidone and N-vinylimidazole; polyvinylpyrrolidones; polyvinyloxazolidones; polyvinylimidazoles; and mixtures thereof; wherein said agents have a particle size less than 50 microns;

b) from 0.2% to 25% by weight of a surfactant system, said surfactant system comprising one or more detersive surfactants selected from the group consisting of anionic, nonionic, cationic, zwitterionic, ampholytic surfactants, and mixtures thereof; and c) the balance carriers and adjunct ingredients.

2. A composition according to claim 1 further comprising a water soluble dye transfer agent, said agent selected from the group consisting of polyamine N-oxide polymers having a molecular weight of from about 1,000 to about 50,000 daltons; copolymers of N-vinylpyrrolidone and N-vinylimidazole having a molecular weight of from about 5,000 to about 50,000 daltons; polyvinylpyrrolidone, polvinyloxazolidone, polyvinylimidazoles, and mixtures thereof.

3. A composition according to claim 2 wherein the ratio of water-insoluble agents to the water soluble agents is from 10:0.1 to 1:5.

4. A composition according to claim 1 further comprising from 0.5% to 10% by weight of a bleaching system, said bleaching system comprising:

i) from 40% to 99.9% by weight, a source of hydrogen peroxide; and ii) from 0.01% to 60% by weight, of a bleach activator.

5. A composition according to claim 4 wherein said source of hydrogen peroxide is selected from the group consisting of hydrogen peroxide, sodium perborate, sodium carbonate peroxyhydrate, sodium pyrophosphate peroxyhydrate, urea peroxyhydrate, sodium peroxide, and mixtures thereof; and said bleach activator is selected from the group consisting of tetraacetyl ethylene diamine, benzoylcaprolactam, 4-nitrobenzoylcaprolactam, 3-chlorobenzoylcaprolactam, benzoyloxybenzenesulphonate, nonanoyloxybenzenesulphonate, phenyl benzoate, decanoyloxybenzenesulphonate, dodecanoyloxybenzenesulphonate, benzoylvalerolactam, octanoyloxybenzenesulphonate, decanoyloxybenzoic acid, perhydrolyzable esters and mixtures thereof.

6. A composition according to claim 1 wherein said surfactant system comprises:

i) one or more anionic sulphonate surfactants, said sulphonate surfactants selected from the group consisting of $C_9$–$C_{15}$ linear alkylbenzene sulphonate, $C_{12}$–$C_{18}$ α-sulphonated methyl fatty acid esters, and mixtures thereof; and ii) one or more anionic $C_{12}$–$C_{18}$ alkyl sulphate surfactants;

provided the ratio of sulphonate surfactant to sulphate surfactant is from 5:1 to 1:2.

7. A composition according to claim 1 further comprising an enzyme selected from the group consisting of protease, lipase, amylase, cellulase, peroxidase, and mixtures thereof.

8. A composition according to claim 1 wherein said adjunct ingredients are selected from the group consisting of builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

9. A laundry detergent composition comprising:

a) 0.01% to 3% by weight, of a substantially water-insoluble polymeric dye transfer inhibiting agent, said agent consisting of a substantially water-insoluble cross linked polymer selected from the group consisting of polyamine N-oxide polymers; copolymers of N-vinylpyrrolidone and N-vinylimidazole; polyvinylpyrrolidones; polyvinyloxazolidones; polyvinylimidazoles; and mixtures thereof; wherein said agents have a particle size from about 10 to about 30 microns;

b) a water soluble dye transfer agent, said agent selected from the group consisting of polyamine N-oxide polymers having a molecular weight of from about 1,000 to about 50,000 daltons; copolymers of N-vinylpyrrolidone and N-vinylimidazole having a molecular weight of from about 5,000 to about 50,000 daltons; polyvinylpyrrolidone, polvinyloxazolidone, polyvinylimidazoles, and mixtures thereof;

provided the ratio of water-insoluble agents of (a) to the water soluble agents of (b) is from 10:0.1 to 1:5; and c) the balance carriers and adjunct ingredients.

10. A composition according to claim 9 wherein said adjunct ingredients are selected from the group consisting of builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

* * * * *